US008994525B2

(12) United States Patent
Piccolo, III et al.

(10) Patent No.: US 8,994,525 B2
(45) Date of Patent: Mar. 31, 2015

(54) METHOD FOR TESTING NOTIFICATION APPLIANCES IN ALARM SYSTEMS

(71) Applicant: SimplexGrinnell LP, Westminster, MA (US)

(72) Inventors: Joseph Piccolo, III, Fitzwilliam, NH (US); David Dahlstrom, Hubbardston, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 92 days.

(21) Appl. No.: 13/836,942

(22) Filed: Mar. 15, 2013

(65) Prior Publication Data

US 2014/0266677 A1 Sep. 18, 2014

(51) Int. Cl.
*G08B 29/00* (2006.01)
*G08B 29/12* (2006.01)

(52) U.S. Cl.
CPC ..... *G08B 29/00* (2013.01); *G08B 29/126* (2013.01)
USPC ..... 340/514

(58) Field of Classification Search
CPC ..... G08B 17/00; G08B 19/00; G08B 13/00; G08B 25/00; G08B 29/00; G01R 1/00; G05B 1/00; G05B 23/00
USPC ..... 340/514, 506, 516, 539.1, 13.24, 340/309.16; 324/537, 754.19, 754.29
See application file for complete search history.

(56) References Cited

U.S. PATENT DOCUMENTS 4,692,750 A * 9/1987 Murakami et al. ..... 340/588
4,884,059 A * 11/1989 Shapiro ..... 340/514
6,208,257 B1 3/2001 Choi
6,313,744 B1 11/2001 Capowski et al.
7,382,245 B2 * 6/2008 Girouard ..... 340/511
RE41,871 E * 10/2010 Capowski et al. ..... 340/514
2005/0216263 A1 9/2005 Obranovich et al.
2014/0197856 A1 * 7/2014 Ostrovsky et al. ..... 324/750.3

FOREIGN PATENT DOCUMENTS

EP 1098284 A2 5/2001
EP 1420374 A1 5/2004

OTHER PUBLICATIONS

International Search Report and Written Opinion dated Jul. 10, 2014, from corresponding PCT/US2014/025838, filed Mar. 13, 2014 (twelve (12) sheets).

* cited by examiner

*Primary Examiner* — Phung Nguyen
(74) *Attorney, Agent, or Firm* — Kacvinsky Daisak Bluni PLLC

(57) ABSTRACT

A method for testing notification appliances in an alarm system and creating a record of such testing including the steps of placing an alarm system in a test mode, actuating an input device of a notification appliance in the alarm system a first time, whereby a notification feature of the notification appliance is activated for a test period, and automatically entering a waiting period after expiration of the test period. The method may further include actuating the input device of the notification appliance a second time during the waiting period, whereby a pass signal is transmitted from the notification appliance, and creating a record of the pass signal. The method may further include transmitting a fail signal from the notification appliance after expiration of the waiting period if the input device of the notification appliance was not actuated during the waiting period and creating a record of the fail signal.

19 Claims, 5 Drawing Sheets

METHOD FOR TESTING NOTIFICATION APPLIANCES IN ALARM SYSTEMS

FIELD OF THE DISCLOSURE

The disclosure relates generally to the field of alarm systems, and more particularly to an improved method for testing notification appliances in alarm systems and recording the results of such testing.

BACKGROUND OF THE DISCLOSURE

Alarm systems, such as fire alarm systems, typically include a plurality of notification appliances (e.g. horn/strobe units), that are installed throughout a monitored building and are configured to be activated upon the detection of an alarm condition, such as the presence of fire or smoke. Occupants of the building may thereby be notified of a potentially hazardous condition and may evacuate the building or take other action before being harmed. It is therefore critically important that notification appliances of alarm systems always be in good working order.

Governmental entities may require that notification appliances, and particularly those of fire alarm systems, be tested periodically to verify that such appliances are operating properly. Such testing is typically performed by one or more designated inspectors who walk through an entire monitored building and physically visit each notification appliance installed therein. The inspectors may activate each appliance for a predetermined amount of time to verify functionality.

One shortcoming associated with traditional notification appliance testing methods is that they require inspectors to manually record test results, such as whether a particular appliance passed or failed testing. This is generally accomplished by noting test results on a piece of paper or by entering test results into an arbitrary electronic device (e.g. laptop, tablet, personal data assistant, etc.). Such manual notation can be extremely time consuming and cumbersome, especially in systems having hundreds or thousands of notification appliances.

A further shortcoming associated with traditional testing methods is that, when noting test results, inspectors must unambiguously identify each appliance that is tested. This can be surprisingly difficult, since appliance differentiation within a large group of nearly identical appliances in a building requires complex descriptions of appliances' locations and/or tedious notation of appliances' serial and device numbers. In addition to being arduous, such manual identification is susceptible to a certain level of inconsistency that is naturally attendant with any complex, manual task of this type.

SUMMARY

In view of the foregoing, it would be advantageous to provide inspectors and other interested parties with convenient and reliable means for testing notification appliances in alarm systems and creating a record of such testing.

An exemplary method in accordance with the present disclosure may include the steps of placing an alarm system in a test mode, actuating an input device of a notification appliance a first time, whereby a notification feature of the notification appliance is activated for a test period, and automatically entering a waiting period after expiration of the test period. The method may further include actuating the input device of the notification appliance a second time during the waiting period, whereby a pass signal is transmitted from the notification appliance, and creating a record of the pass signal. The method may further include transmitting a fail signal from the notification appliance after expiration of the waiting period if the input device of the notification appliance was not actuated during the waiting period, and creating a record of the fail signal.

DETAILED DESCRIPTION

Figure 1:
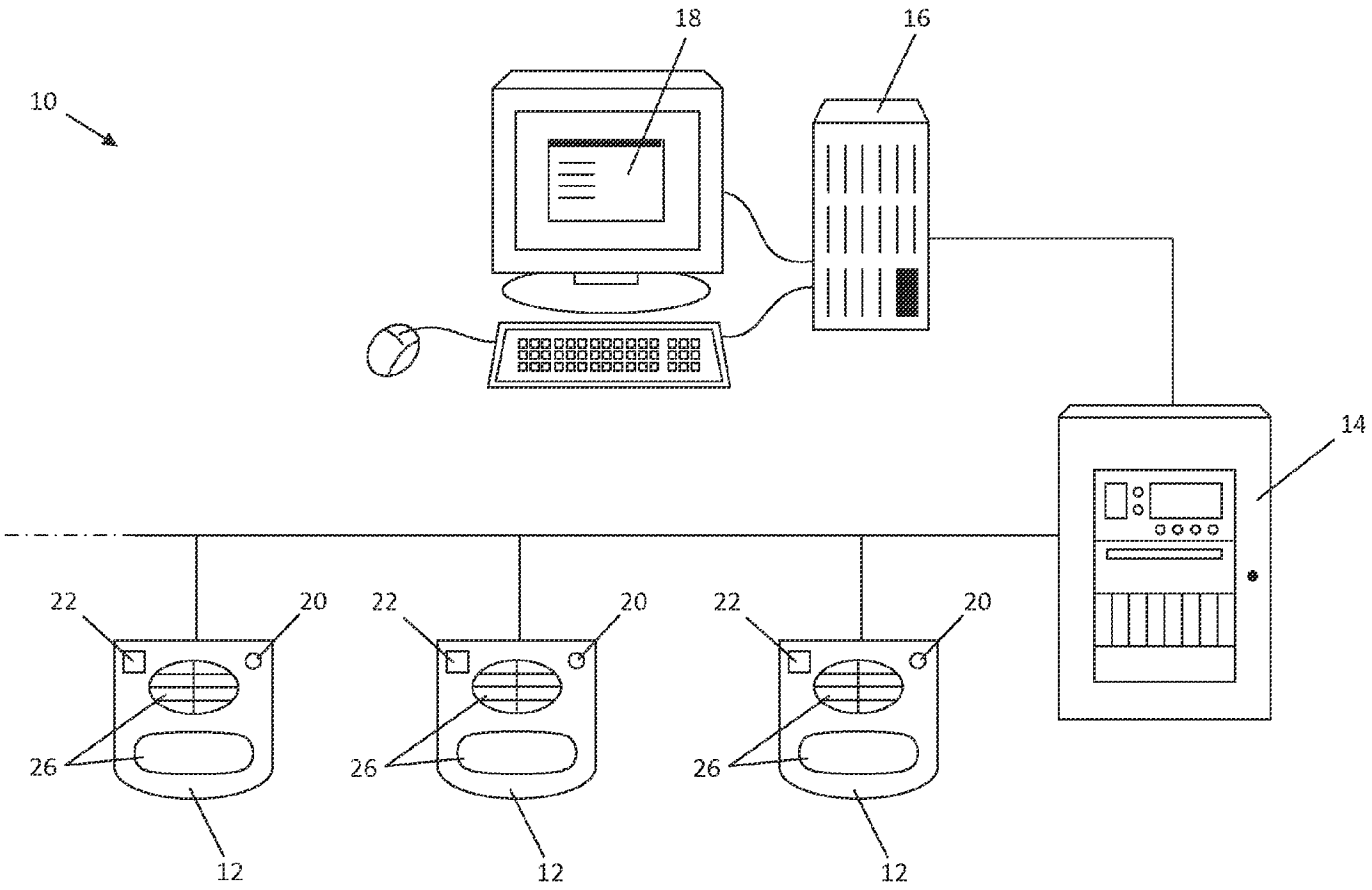
FIG. 1 is a schematic diagram illustrating an exemplary embodiment of an alarm system in accordance with the present disclosure.

Methods for testing notification appliances and recording the results of such testing in accordance with the present disclosure will now be described more fully hereinafter with reference to the accompanying drawings, in which preferred embodiments of the invention are shown. The disclosed methods, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the methods described herein may be implemented in virtually any type of alarm or monitoring system, including, but not limited to, fire alarm systems, burglar alarm systems, surveillance systems, air quality monitoring systems, inventory monitoring systems, etc., or any combination thereof, such as may be provided for detecting an alarm event (e.g. a security breach) or a warning condition (e.g. an elevated temperature) in a building, structure, enclosure, or area. Many other applications are contemplated and may be implemented without departing from the scope of the present disclosure. All such applications are collectively referred to herein as "alarm systems."

Referring to FIG. 1, an exemplary alarm system 10 in accordance with the present disclosure is shown. The alarm system 10 may include a plurality of notification appliances 12 that may be installed throughout a monitored structure and connected to one or more alarm panels 14. Each notification appliance 12 may be associated with a unique address within the alarm system 10 for facilitating identification thereof by the alarm panel 14 and enabling selective routing of command/control signals from the alarm panel 14 to each notification appliance 12. The notification appliances 12 may be configured to provide notification of an alarm condition within the structure, such as may be detected by one or more initiating devices (not shown) in the alarm system 10. The notification appliances 12 shown in FIG. 1 are strobe/horn units, but it is contemplated that other varieties of notification appliances, such as sirens, bells, buzzers, etc., may additionally or alternatively be implemented in the alarm system 10 in a similar manner. For the sake of convenience and clarity, only three notification appliances 12 are shown, but it is to be understood that the alarm system 10 may include many additional notification appliances 12 without departing from the scope of the present disclosure.

The exemplary alarm system 10 may also include a workstation 16, such as a personal computer (PC) or server, which is operatively connected to the alarm panel 14. The workstation 16 may be loaded with one or more software applications that provide human operators of the system 10 with a user interface 18 for monitoring and controlling certain aspects of the alarm system 10. For example, the user interface 18 may allow an operator to observe the functional status of the notification appliances 12, and to activate, deactivate, test, inspect, or otherwise exert control over the notification appliances 12 as further described below. Alternatively, it is contemplated that the workstation 16 and user interface 18 may be entirely omitted from the alarm system 10, and that an operator may activate, deactivate, test, inspect, observe the functional status of, or otherwise exert control over the notification appliances 12 via the alarm panel 14.

Each of the notification appliances 12 may be equipped with one or more waiting mode indicia 20. The waiting mode indicia 20 may be configured to be activated upon completion of a functional test of a respective notification appliance 12 as further described below. The waiting mode indicia 20 may include any type of visual indicia that are capable of being activated in response to an electrical signal, including, but not limited to, light emitting diodes (LEDs), incandescent light bulbs, fluorescent light bulbs, liquid crystal displays (LCDs), strobes, and the like. Such visual indicia 20 may be prominently located on the exteriors of the notification appliances 12. The waiting mode indicia 20 may additionally or alternatively include any type of audible indicia that are capable of being activated in response to an electrical signal, including, but not limited to, sirens, horns, bells, buzzers, and the like.

Each of the notification appliances 12 may be further provided with a manually actuated input device 22, such as a switch or a button. The input devices 22 may be configured such that actuation of an input device 22 may cause a respective notification appliance 12 to perform a functional test, whereby the notification feature(s) 26 (e.g. strobe and horn) of the notification appliance 12 are activated for a predefined amount of time, hereinafter referred to as "the testing period." An inspector may thereby determine whether the notification appliance 12 is operating properly. The input devices 22 may be further configured such that actuating an input device 22 a second time after the testing period has concluded may cause the notification appliance 12 to transmit a pass signal to the alarm panel 14, wherein such pass signal indicates that the notification appliance 12 passed the functional test. The purpose and operation of the input devices 22 will be described in greater detail below within the context of the disclosed testing methods.

The input devices 22 shown in FIG. 1 may be magnetic switches that are actuated by waving a magnetic key 24 (shown in FIG. 4) in close proximity thereto. Such magnetic keys 24 may be made available to a designated system inspector or group of designated system inspectors. Limiting access to the input devices 22 in this manner is advantageous because it prevents unauthorized individuals from interfering with the inspection and testing of the alarm system 10. However, it is contemplated that various other types of input devices 22 may additionally or alternatively be implemented without departing from the present disclosure. For example, it is contemplated that the input devices 22 may be simple buttons or switches that can be actuated by any individual.

Figure 2:
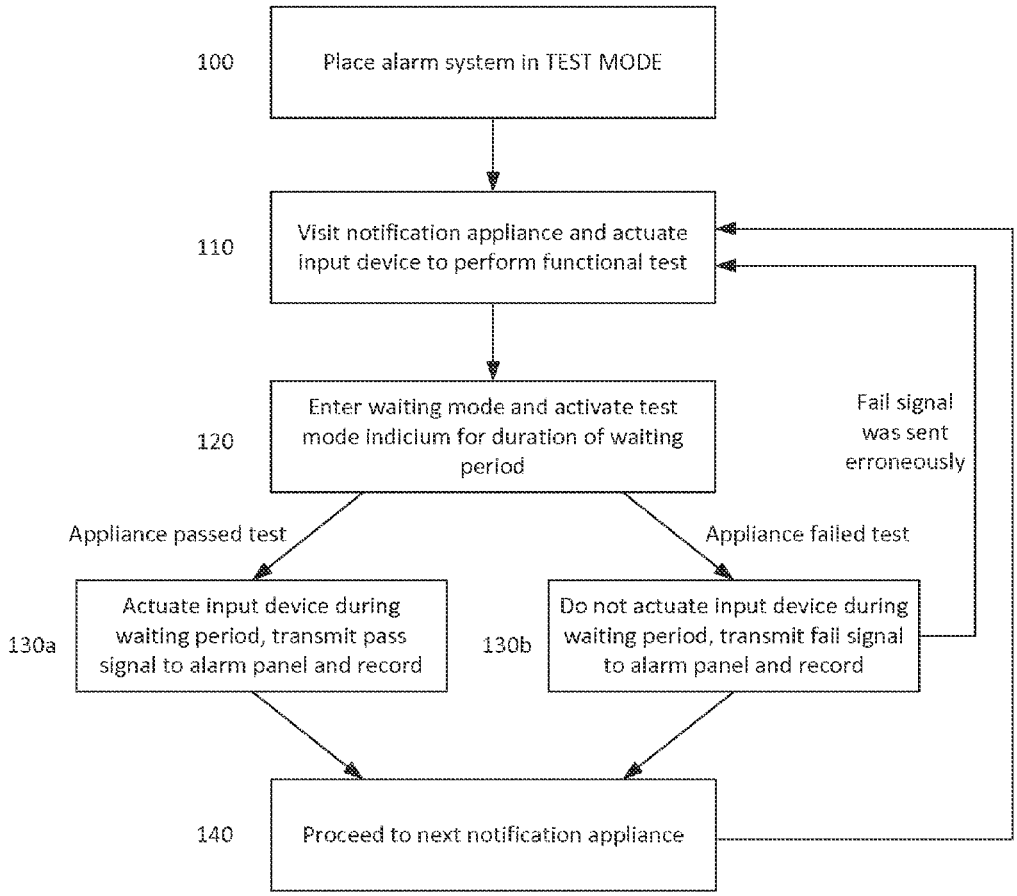
FIG. 2 is a flow diagram illustrating an exemplary embodiment of a method in accordance with the present disclosure.

Referring to FIG. 2, a flow diagram illustrating an exemplary method for testing the notification appliances 12 of the alarm system 10 in accordance with the present disclosure is shown. The method will now be described in detail in conjunction with the schematic representations of the alarm system 10 shown in FIGS. 3-8.

Figure 3:
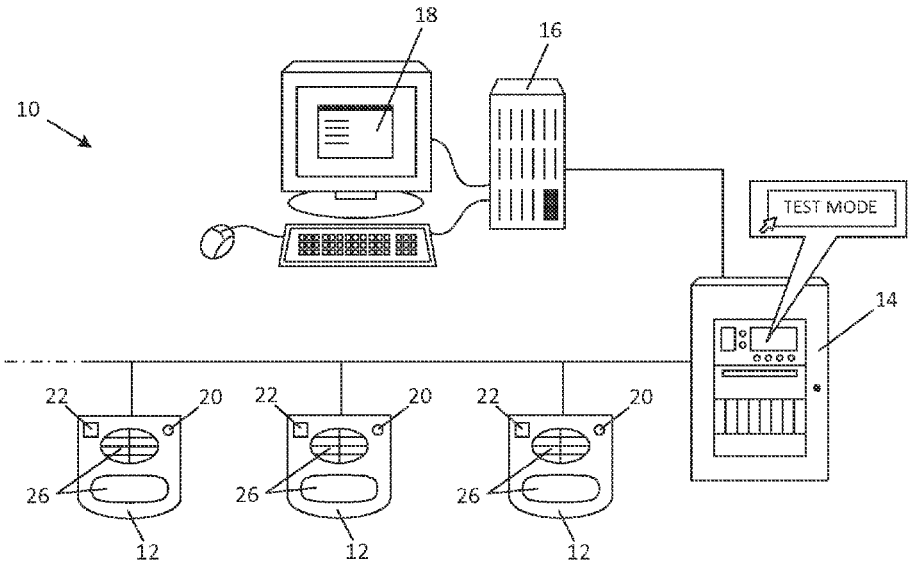
FIGS. 3-8 are a series of schematic diagrams illustrating the exemplary method shown in FIG. 2 being performed on the alarm system shown in FIG. 1.

At a first step 100 of the exemplary testing method, an inspector may place the system 10 in a "test mode." This may be achieved by the inspector making an appropriate selection in the user interface 18 or at the alarm panel 14, such as by selecting a "TEST MODE" option in a menu or sub-menu of the alarm panel 14 as shown in FIG. 3. The inspector may further be provided with an option to initiate a "self-test" of the alarm system (further described below).

Figure 4:
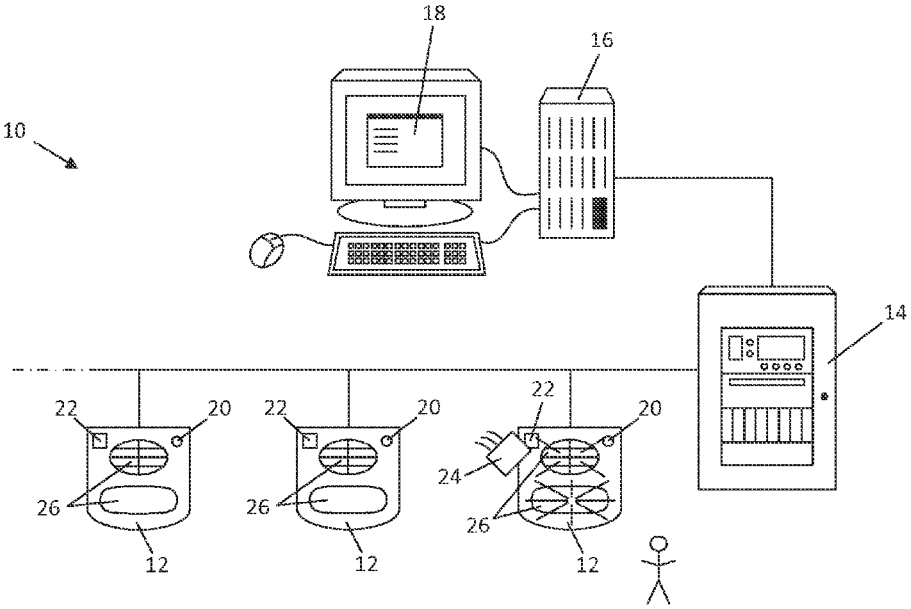

At step 110 of the exemplary method, the inspector may visit a first of the notification appliances 12 and may actuate the input device 22 of the notification appliance 12. For example, the inspector may wave a magnetic key 30 (described above) in close proximity to the input device 22 as shown in FIG. 4. Actuating the input device 22 thusly may cause the notification appliance 12 to perform a functional test by activating its notification features 26 for a test period of predetermined duration (e.g. 5 or 10 seconds). For example, the notification appliance 12 may flash its strobe and/or sound its horn as shown in FIG. 4. Of course, the particular type of functional test performed will depend on the particular type of notification appliance 12 being tested. The functional test may allow the inspector to determine whether the notification appliance 12 operates as intended (e.g. at a sufficient volume or brightness).

Figure 5:
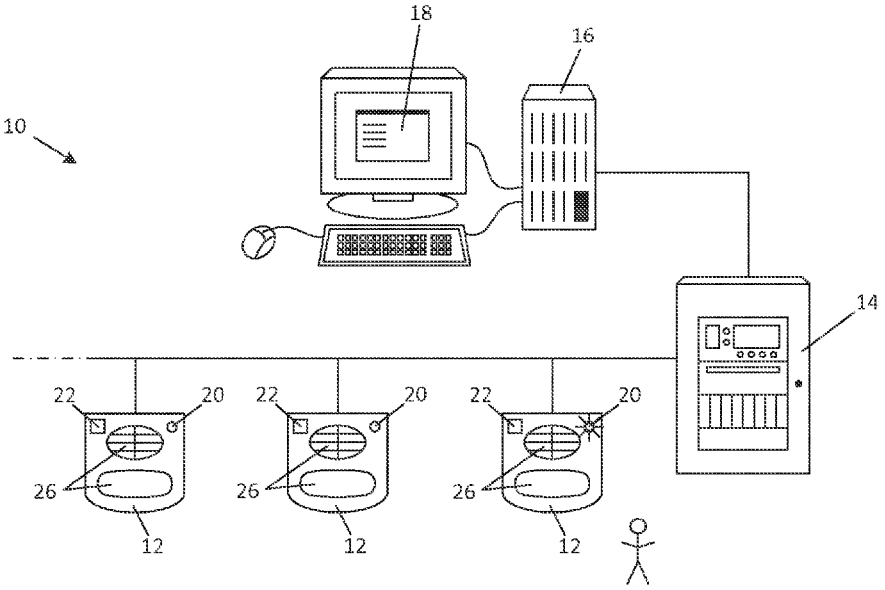

Upon completion of the functional test, the notification appliance 12 may, at step 120 of the exemplary method, automatically enter a "waiting mode" (described in greater detail below). The notification appliance 12 may positively indicate that it is in the waiting mode by activating its waiting mode indicium 20 as shown in FIG. 5. The notification appliance 12 may remain in the waiting mode, and the verification indicium 20 may remain activated, for a predefined amount of time, hereinafter referred to as "the waiting period." The duration of the waiting period may be in a range of 30 to 60 seconds, but may be shorter or longer without departing from the present disclosure.

Figure 6:
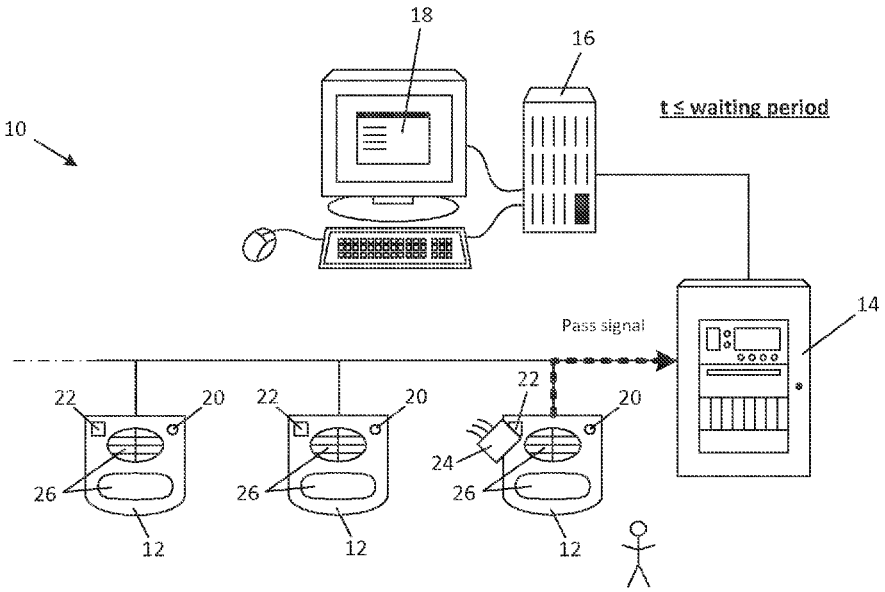
Figure 7:
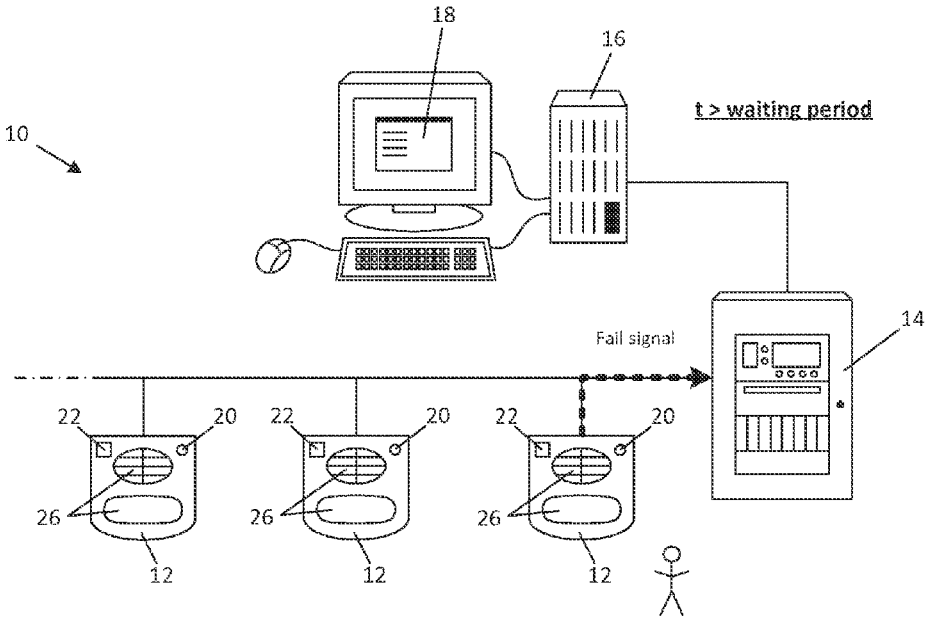

If the inspector determines that the notification appliance 12 functioned properly during the functional test performed in step 110, the inspector may, at step 130*a* of the exemplary method, actuate the input device 22 of the notification appliance 12 before the expiration of the waiting period (i.e. while the waiting mode indicium 20 is activated) as shown in FIG. 6. Such actuation may be performed in substantially the same manner as described in step 110, such as by waving the magnetic key 30 in close proximity to the input device 22. Alternatively, it is contemplated that the notification appliance may be provided with a separate input device (i.e. separate from input device 22) that may be actuated in a similar or different manner during this step for indicating passage of the functional test.

By actuating the input device 22 during the waiting period, the inspector may cause the notification appliance 12 to transmit a "pass signal" to the alarm panel 14 as indicated by the dashed arrow in FIG. 6, wherein such signal indicates that the notification appliance 12 passed the functional test performed in step 110. Actuation of the input device 22 during the waiting period may also cause the notification appliance 12 to conclude the waiting period and to deactivate its waiting mode indicium 20, indicating to the inspector that the pass signal was transmitted. Upon receiving the pass signal, the alarm panel 14 may record the unique address of the tested notification appliance 12, and may also record the date and time when the pass signal was received. The alarm panel 14 may further record a unique identification number associated with the magnetic key 30 that was used to actuate the input device 22 if such information was captured by the notification appliance 12 and conveyed by the pass signal. Alternatively, it is contemplated that the above-described functions of receiving the verification signal, creating an inspection record, as well as all other command, control, and storage functions described below, may instead be performed by the workstation 16.

If the inspector determined that the notification appliance 12 did not function properly during the functional test performed in step 110, the inspector may, at step 130*b* of the exemplary method, allow the waiting period to expire without actuating the input device 22. Expiration of the waiting period may be indicated by deactivation of the waiting mode indicium 20. If the waiting period is allowed to expire in this manner, the notification appliance 12 may automatically transmit a "fail signal" to the alarm panel 14 upon conclusion of the waiting period as indicated by the dashed arrow shown in FIG. 7, wherein such signal indicates that the notification appliance 12 failed the functional test performed in step 110. Alternatively or additionally, it is contemplated that the notification appliance 12 may be provided with a separate input device (i.e. separate from the input device 22) that the inspector may actuate to cause the fail signal to be transmitted to the alarm panel 14.

Upon receiving the fail signal, the alarm panel 14 may record the unique address of the tested notification appliance 12, and may also record the date and time when the fail signal was received. The alarm panel 14 may further record a unique identification number associated with the magnetic key 30 that was used to actuate the input device 22 if such information was captured by the notification appliance 12 and conveyed by the fail signal.

If the inspector determined that the notification appliance 12 functioned properly during the functional test of step 110, but allowed the waiting period to expire without actuating the input device 22 for some reason (e.g. the inspector became distracted or was unexpectedly called away from notification appliance 12), the fail signal may be transmitted to the alarm panel 14 in error. If the inspector wishes to subsequently transmit and record a correct pass signal for the notification appliance 12, the inspector may simply repeat steps 110-130*a* of the method on notification appliance 12. Particularly, the inspector may actuate the input device 22 of the notification appliance 12 to again perform a functional test, and may again actuate the input device 22 during the subsequent waiting period to cause a pass signal to be transmitted to the alarm panel 14. This pass signal may supersede the previously transmitted fail signal, and the alarm panel 14 may replace the previously recorded fail result with a pass result for the notification appliance 12. The inspector is thereby relieved from having to manually record an exception to the test, or from having to start the entire system test over again.

It is contemplated that, instead of requiring the inspector to observe the functional test of the notification appliance 12 and subjectively determine whether the appliance performed adequately as described above, one or more of the notification appliances 12 in the alarm system 10 may be equipped with a so-called "self-test" feature which enables a notification appliance 12 to automatically evaluate its own functionality. For example, such a notification appliance 12 may include one or more sensors (not shown), such as a microphone, sound detector, camera, photo eye, light detector, etc., located adjacent the appliance's notification features 26 (e.g. strobes, horns, sirens, etc.). Upon initiating a self-test of a properly equipped notification appliance 12, such as by actuating the input device 22 as in step 110 of the exemplary method, the notification appliance 12 may activate its notification features 26 to perform a functional test as described above. While the functional test is being performed, the sensor(s) of the notification appliance 12 may measure the output of the appliance's notification features 26. The measured output may then be compared to predefined values to determine whether the notification appliance 12 is functioning properly. Such comparison may be performed by the notification appliance 12 itself, by the alarm panel 14, or by the workstation 16, and the results of the self-test may be automatically entered into the test record (described above). The inspector is thereby relieved from having to observe and subjectively determine the results of a functional test.

By collecting pass/fail information in the manner described above, the alarm panel 14 may automatically create and store a test record for the notification appliance 12, including when and by whom the notification appliance 12 was tested. Such a record may subsequently be reviewed by interested parties, and may provide confirmation that the notification appliance 12 was in-fact tested.

Figure 8:
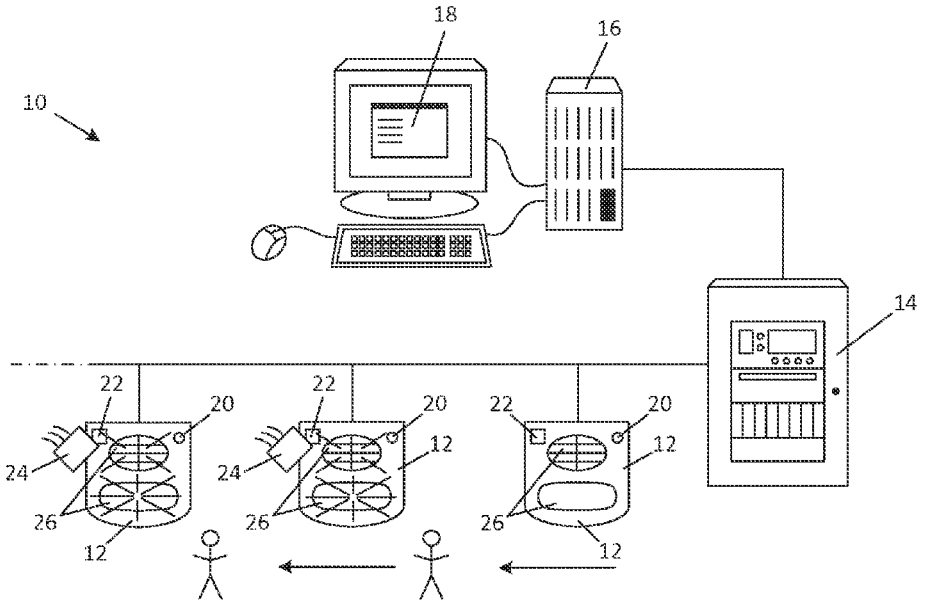

At step 140 of the exemplary method, the inspector may proceed to the other notification appliances 12 in the alarm system 10 and may sequentially test each appliance in the manner described in steps 110-130 above, as represented in FIG. 8. Particularly, the inspector may actuate the input device 22 of each notification appliance 12 to effectuate a functional test thereof, and may cause a pass or fail signal to be transmitted to the alarm panel 14 for each appliance connected thereto. A full test record for the entire alarm system 10 may thereby be automatically created and stored in the manner described above.

The method described herein thus provides inspectors and other interested parties with convenient, reliable means for testing notification appliances in alarm systems and for creating and storing records of such testing.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above, for example, the alarm system workstations, broker workstations, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A method for testing notification appliances in an alarm system, the method comprising:

actuating an input device on a notification appliance a first time, whereby a notification feature of the notification appliance is activated for a test period;

automatically entering a waiting period after expiration of the test period; and activating a waiting mode indicium on the notification appliance during the waiting period.

2. The method of claim 1, further comprising actuating the input device on the notification appliance a second time during the waiting period, whereby a pass signal is transmitted from the notification appliance.

3. The method of claim 2, further comprising deactivating the waiting mode indicium.

4. The method of claim 2, further comprising creating a record of the pass signal, such record including an address of the notification appliance and a time and date when the pass signal was received.

5. The method of claim 4, wherein the record further includes an identifier associated with a key that was used to actuate the input device.

6. The method of claim 4, further comprising storing the record and making the record available for subsequent review.

7. The method of claim 1, further comprising transmitting a fail signal from the notification appliance after expiration of the waiting period if the input device was not actuated a second time during the waiting period.

8. The method of claim 7, further comprising deactivating the waiting mode indicium after expiration of the waiting period.

9. The method of claim 7, further comprising creating a record of the fail signal, such record including an address of the notification appliance and a time and date when the fail signal was received.

10. The method of claim 9, wherein the record further includes an identifier associated with a key that was used to actuate the input device.

11. The method of claim 9, further comprising storing the record and making the record available for subsequent review.

12. The method of claim 1, further comprising placing the alarm system in a test mode before actuating the input device on the notification appliance a first time.

13. The method of claim 12, wherein placing the alarm system in the test mode comprises selecting a corresponding test mode option.

14. The method of claim 1, further comprising repeating the steps of actuating an input device and automatically entering a waiting period for every other notification appliance in the alarm system.

15. The method of claim 1, wherein the step of actuating the input device comprises disposing a magnet in close proximity to a magnetic switch in the notification appliance.

16. A method for testing notification appliances in an alarm system, the method comprising:

actuating an input device on the notification appliance a first time, whereby a notification feature of the notification appliance is activated for a test period;

automatically entering a waiting period after expiration of the test period;

actuating the input device on the notification appliance a second time during the waiting period, whereby a pass signal is transmitted from the notification appliance; and creating a record of the pass signal, such record including an address of the notification appliance and a time and date when the pass signal was received.

17. The method of claim 16, further comprising storing the record and making the record available for subsequent review.

18. A method for testing notification appliances in an alarm system, the method comprising:

actuating an input device on the notification appliance a first time, whereby a notification feature of the notification appliance is activated for a test period;

automatically entering a waiting period after expiration of the test period;

transmitting a fail signal from the notification appliance after expiration of the waiting period; and creating a record of the fail signal, such record including an address of the notification appliance and a time and date when the fail signal was received.

19. The method of claim 18, further comprising storing the record and making the record available for subsequent review.

* * * * *